US007040625B1

(12) United States Patent
D'Avanzo

(10) Patent No.: US 7,040,625 B1
(45) Date of Patent: May 9, 2006

(54) CARD GAME

(75) Inventor: Scott D'Avanzo, Ladera Ranch, CA (US)

(73) Assignee: Adrenalin Gaming LL C, Ladera Ranch, CA (US)

( * ) Notice: Subject to any disclaimer, the term of this patent is extended or adjusted under 35 U.S.C. 154(b) by 46 days.

(21) Appl. No.: 10/868,552

(22) Filed: Jun. 15, 2004

(51) Int. Cl.
*A63F 1/00* (2006.01)

(52) U.S. Cl. ..... 273/292

(58) Field of Classification Search ..... 273/292, 273/209, 274; 463/12, 13
See application file for complete search history.

(56) References Cited

U.S. PATENT DOCUMENTS 5,320,356 A * 6/1994 Cauda ..... 273/292
5,934,675 A * 8/1999 Handelman et al. ..... 273/292

* cited by examiner

*Primary Examiner*—Benjamin Layno
(74) *Attorney, Agent, or Firm*—Rob L. Philips; Greenberg Traurig

(57) ABSTRACT

Disclosed is a card game wherein each player first places three separate wagers of equal value. Then, a dealer deals each player three face-up cards corresponding to each wager and deals himself or herself one card face up and one card face down. Two of the player cards are designated Blackjack cards and along with the dealer's face up card form two separate Blackjack hands. The third card is a bonus card that the player may decide to move to either of the two Blackjack hands along with its corresponding wager. Otherwise, the bonus card and corresponding wager is forfeited. Once a decision regarding the bonus card has been made, the player plays the two Blackjack hands, both hands including the dealer's face up card, according to the conventional rules of Blackjack. Payouts correspond to conventional Blackjack.

12 Claims, 4 Drawing Sheets

CARD GAME

FIELD OF THE INVENTION

The embodiments of the present invention relate to a wagering game. More particularly, the embodiments of the present invention relate to a card game.

BACKGROUND

As gaming continues to enjoy widespread acceptance, casinos are in constant need of new games of chance to retain experienced patrons and to attract new patrons. While electronic gaming devices (e.g., slot machines) now generate more revenue than table games, many players prefer the skill requirements and personal interaction of live gaming. Thus, live gaming continues to be integral part of the success of any casino.

However, as space for table games continues to be usurped by electronic gaming machines, the casinos tend to very selective with the new games they are willing to place in their floor. Accordingly, since players prefer familiar games, casinos are more likely to consider new games which are based, at least in part, on existing popular games (e.g., Blackjack). Indeed, many Blackjack tables now incorporate side wagers as an additional feature. By selecting games with familiar themes, casinos limit the risk associated with an entirely new game having unfamiliar rules.

Consequently, there continues to be the need for new live games of chance based on well-known games of chance. Moreover, it is also beneficial for the live games to be implementable in an electronic format as well.

SUMMARY

Accordingly, the embodiments of the present invention comprise a card game premised on Blackjack. In a first embodiment, each player must place three equal but separate wagers. A dealer then deals each player three separate face-up cards proximate to each wager. The dealer deals himself or herself two cards with one card face up. Two of the player's three cards are used, with the dealer's face up card, to form two distinct Blackjack hands and the third card acts as a bonus card.

Once the initial cards are dealt, a dealer engages a first player. At this point, the player has two Blackjack hands in play. Each hand includes the dealer's face-up card. With a first embodiment, the player's first decision is then whether or not to use the bonus card with either of the two Blackjack hands. If the player elects to use the bonus card with either Blackjack hand, he notifies the dealer who moves the bonus card and corresponding wager to the selected hand. If the player elects not to use the bonus card with either hand, the player forfeits the bonus card and the corresponding wager. Alternatively, the player must use the bonus card with one of the Blackjack hands. Subsequent to the bonus card decision, the player's two Blackjack hands are completed using conventional Blackjack rules. The dealer then engages each subsequent player at the table such that each player utilizes the dealer's face-up card in their two Blackjack hands.

In a second embodiment, the player may elect to use the bonus card at any time during the play of the two Blackjack hands. That is, the player plays the first Blackjack hand and second Blackjack hand in succession with the option of using the bonus card at any moment desired. However, again, should the player not play the bonus card, the player loses the corresponding wager.

In another embodiment, an electronic gaming device facilitates play of the game. Electronic gaming devices are well-known by those skilled in the art and facilitate many wagering games, including Video Poker, Keno and Blackjack. Other variations, embodiments and features of the present invention will become evident from the following detailed description, drawings and claims.

DETAILED DESCRIPTION

Figure 1:
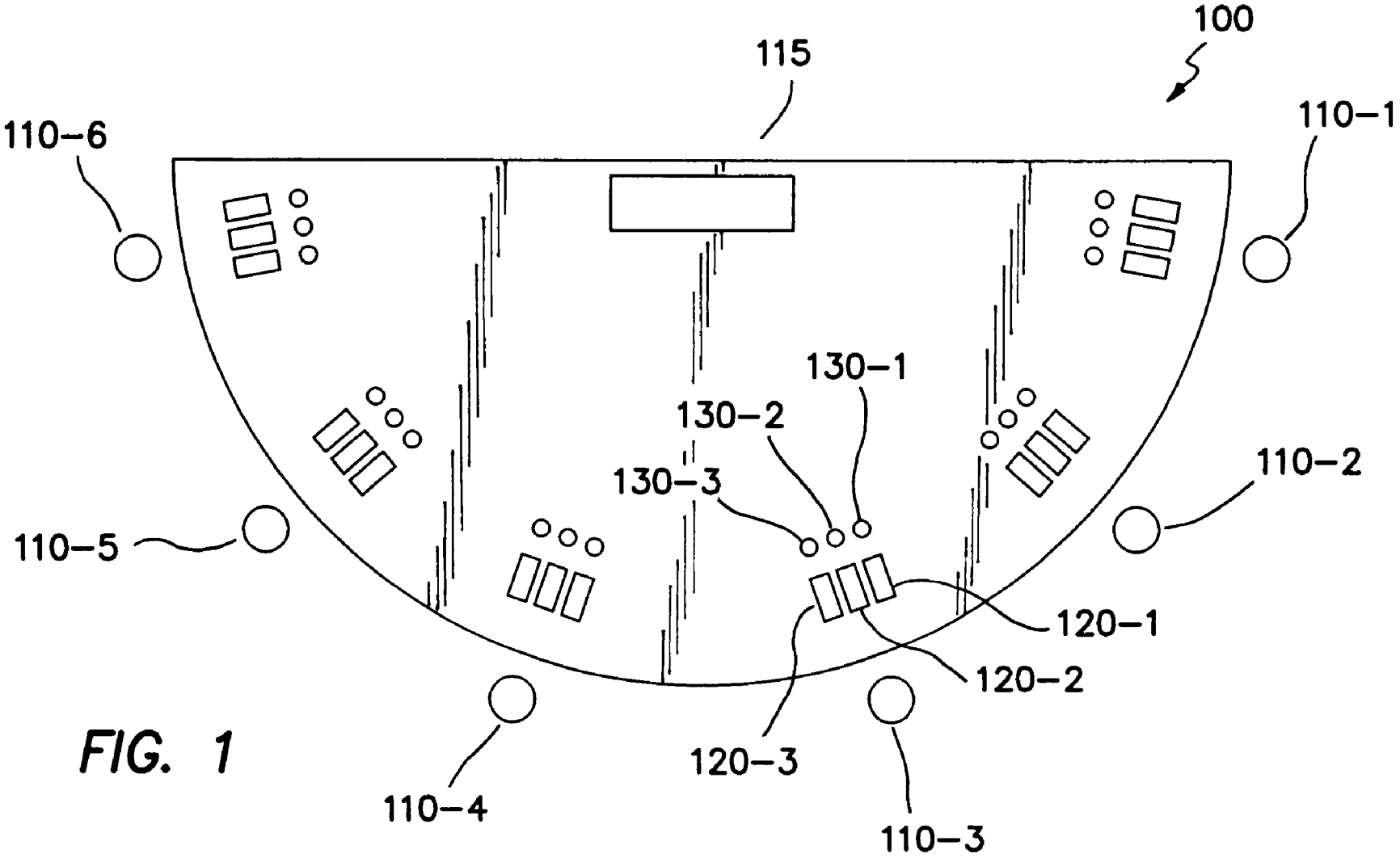
FIG. 1 shows a gaming table layout of a live embodiment of the present invention.

Reference is now made to the figures wherein like parts are referred to by like numerals throughout. FIG. 1 shows a gaming table layout generally referred to by reference numeral 100. The layout 100 accommodates six player positions 110-1 through 110-6 and a dealer position 115. Each player position 110-1 through 110-6 includes three wager areas 120-1 through 120-3 and three card placement spaces, namely a first Blackjack hand space 130-1, a second Blackjack hand space 130-2 and a bonus card space 130-3. A gaming table supporting said layout 100 may also support an automatic card shuffling machine and/or card shoe.

In a first embodiment, the game is played using one to eight standard decks of fifty-two playing cards. It is conceivable that wild cards may be included in the deck or decks as well. Initially, each player places three equal but separate wagers in the wager areas 120-1 through 120-3. Acceptable wagering limits are set by individual casinos. Once the three wagers have been placed, each player is dealt three cards which are placed face up in the three card placement spaces 130-1 through 130-3 and the dealer receives two cards including one face-up card. The order of the card dealing may take any form desired. For example, each player and the dealer may receive one card in succession until each player has three cards and the dealer has two cards.

Once the initial cards are dealt, a first player is engaged by the dealer. An initial player decision relates to the bonus card placed in card space 130-3. The player must decide whether to use the bonus card with either the card in the first Blackjack hand space 130-1 or the card in the second Blackjack hand space 130-2 in combination with the dealer's face-up card. If the player elects to use the bonus card with one of the Blackjack hands, the player notifies the dealer and the dealer moves the bonus card and corresponding wager to the selected Blackjack hand space 130-1 or 130-2 and wager space 120-1 or 120-2, respectively. If the player does not elect to use the bonus card, the dealer collects the bonus card and corresponding wager.

Figure 2A:
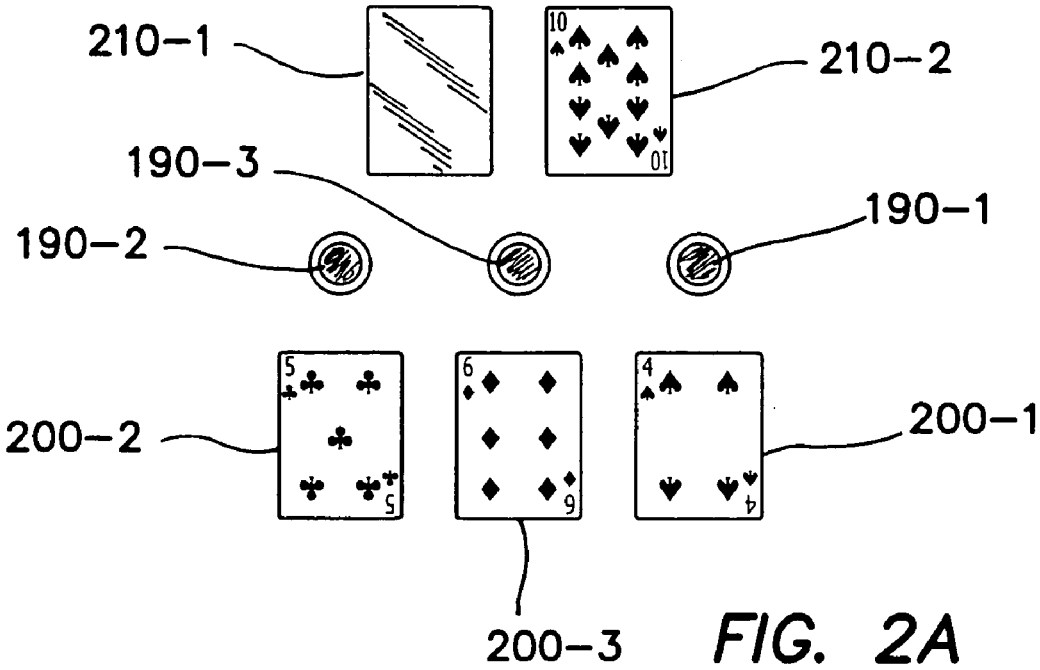
FIGS. 2*a*–2*c* show a play of a hand of a first live embodiment or the present invention.
Figure 2B:
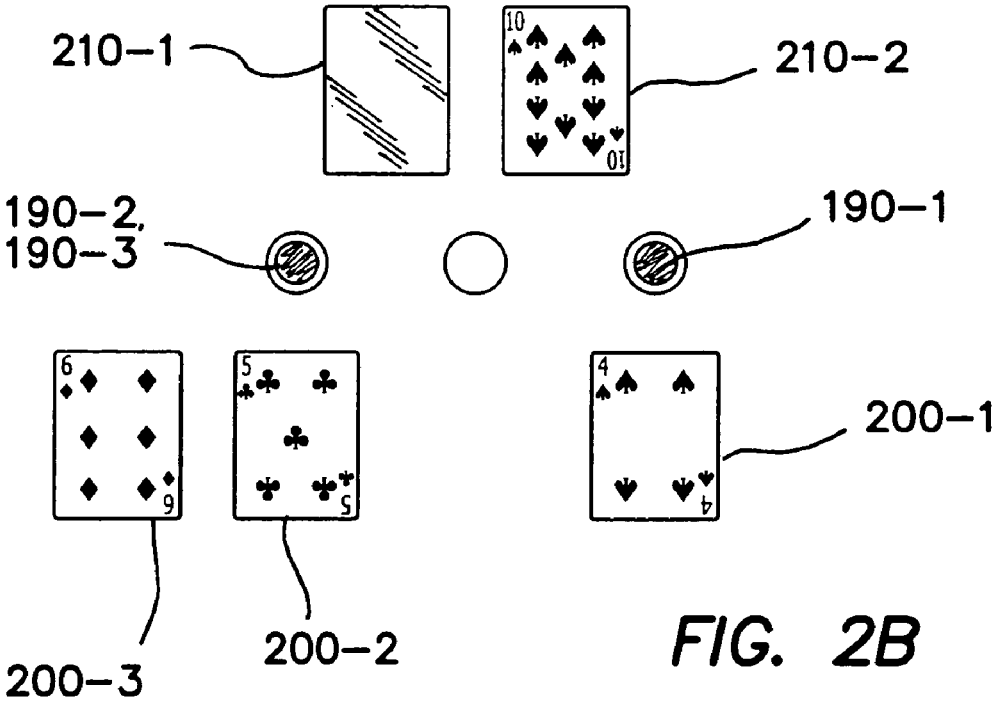
Figure 2C:
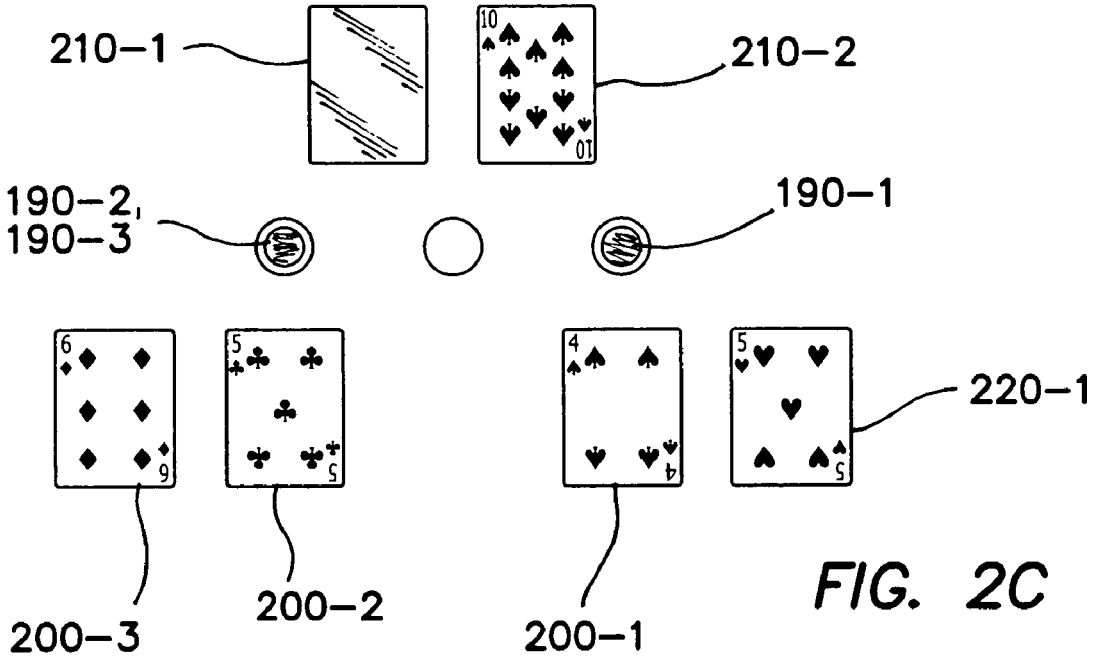

FIGS. 2*a* through 2*c* show play of a sample hand. Specifically, FIG. 2*a* shows a player having placed three wagers 190-1 through 190-3 and having been dealt three cards 200-1 through 200-3 and a dealer having been dealt two cards 210-1 through 210-2. The player has been dealt a first Blackjack hand card 4♠ 200-1, a second Blackjack hand card 5♣ 200-2 and a bonus card 6♦ 200-3. The dealer's face-up card is the 10♠ 210-2. Based on the cards dealt, the prudent play is for the player to play the bonus card 6♦ 200-3 with the second Blackjack hand card 5♣ 200-2 to form a two card total of eleven which in combination with the dealer's face-up card 10♠ 210-2 gives the player a second Blackjack hand total of twenty-one. Thus, as shown in FIG. 2*b*, the player has notified the dealer that he or she desires to play the bonus card 6♦ 200-3 with the second Blackjack card 5♣ 200-2 and the dealer has moved the bonus card 6♦ 200-3 and corresponding wager 190-3 to the second Blackjack hand area. Accordingly, the combination of the second Blackjack hand cards 5♣ 200-2, 6♦ 200-3 and the dealer's face-up card 10♠ 210-2, the player has one Blackjack hand totaling twenty-one. The player's other Blackjack hand comprises the first Blackjack hand card 4♠ 200-1 and the dealer's face-up card 10♠ 210-2. Thus, the player has a total of fourteen. Pursuant to basic Blackjack strategy, a player should hit a card total of fourteen against a dealer face-up card of ten. As shown in FIG. 2*c*, the player has elected to hit the first Blackjack hand and has received a 5♥ 220-1 giving the player a first Blackjack hand total of nineteen which the player should stand on. Thereafter, the dealer engages each other player at the table in the identical fashion. Once all players have played their hands, the dealer exposes his or her face-down card and plays his or her hand according to conventional Blackjack rules (i.e., hit totals of sixteen or less and stand on totals of seventeen or more). After the dealer's hand is complete, the dealer resolves remaining wagers according to the conventional rules of Blackjack. In other words, winning player hands are paid even money (i.e., 1 to 1). Optionally, two card totals of twenty-one may pay a bonus amount (e.g., 3 to 2).

Figure 3:
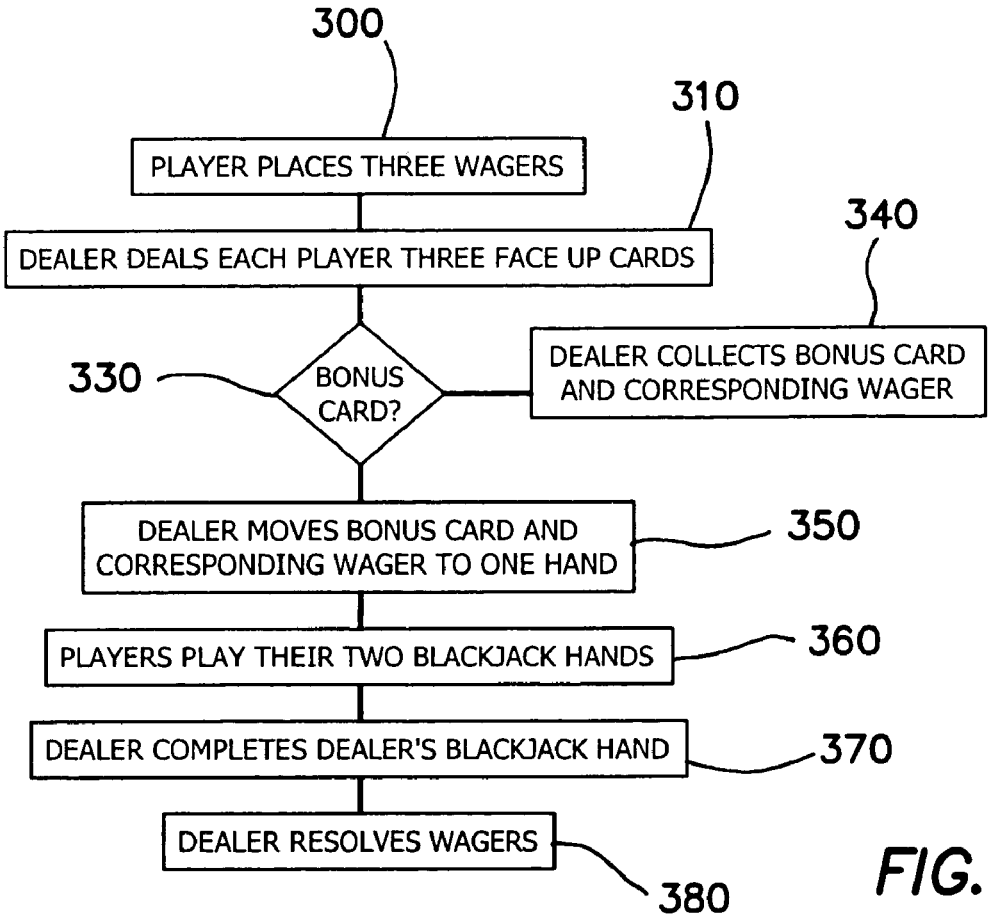
FIG. 3 shows a flow chart detailing the first live embodiment of the present invention.

Now referring to FIG. 3, a flow chart details play of the live embodiment of the present invention. At step 300, players place three wagers. In a first embodiment, the three wagers are of an equal amount. Then, at step 310, the dealer deals each player three face-up cards; one proximate to each wager. Next, at step 320, the players decide whether or not to play the bonus card. If so, at step 330, the player notifies the dealer who moves the bonus card and corresponding wager accordingly. If not, at step 340, the dealer collects the bonus card and corresponding wager. At step 350, the dealer moves the bonus card and corresponding wager to one hand. At step 360, the players play their two Blackjack hands each utilizing the dealer's face-up card. At step 370, the dealer completes his or her own hand. At step 380, the dealer resolves remaining player wagers.

It should be understood that the features, including splitting, doubling down and surrendering may be incorporated into the embodiments of the present invention.

While the description above details a live game, an electronic gaming device may facilitate an electronic embodiment of the game. In an electronic embodiment, once a series of wagers is accepted by the device, the device simulates the deal of the game on a display device. Using a player interface, such as a touch screen display, the player controls the disposition of the bonus card. That is, the player may move the bonus card to one of the Blackjack hands or forfeit the bonus card and corresponding wager. Thereafter, the player elects to hit, stand, double down, split or surrender with respect to each of the two Blackjack hands. Once the player decisions are complete, the device completes the simulated dealer's hand and resolves the remaining wagers.

Figure 4:
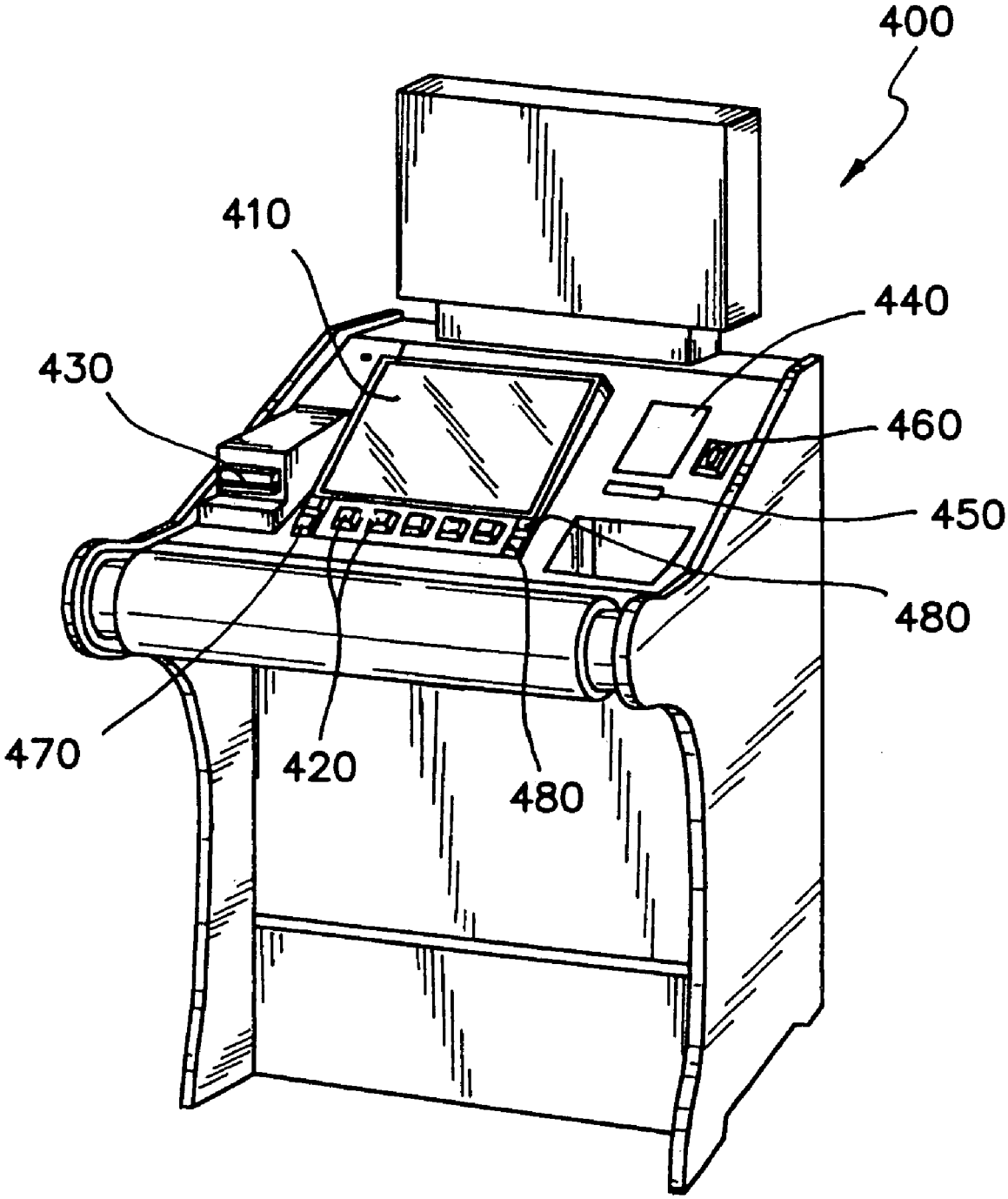
FIG. 4 shows a gaming device of the type which may facilitate the electronic embodiment of the present invention.

FIG. 4 illustrates an electronic gaming device, generally designated as reference numeral 400, of the type that may be used to implement the embodiments of the present invention in an electronic format. The external features of the gaming device 400 include a display 410, wager selection buttons 420, card reader 430, credit display 440, bill reader 450, coin input 460, bonus card button 470 and related Blackjack decision buttons 480. However, the display 410 may also comprise touch screen technology to facilitate simple player interaction. Device switches and similar physical components may also act as player interfaces.

The operation of the gaming device 400 is controlled by a microprocessor that communicates with an internal memory device and the external features of the device 400. The microprocessor also incorporates, or communicates with, a random number generator which ensures the randomness of the cards dealt during the play of the game. Since the technology for operating and controlling gaming devices is well known to those skilled in the art, the subtle details are not described herein.

Although the invention has been described in detail with reference to several embodiments, additional variations and modifications exist within the scope and spirit of the invention as described and defined in the following claims.

I claim:

1. A method of conducting a wagering game comprising:

accepting two or more individual wagers from each player;

providing said players with three or more face-up cards from one or more decks of standard playing cards wherein each of said three or more cards corresponds to one of the two or more wagers;

providing a dealer with two cards, one card face-up, from the one or more decks of standard playing cards;

allowing said players to form two separate blackjack hands using two of the face-up player cards each in combination with the dealer's face-up card;

providing said players with option of utilizing the third player card and corresponding wager with one of the two blackjack hands;

completing the two blackjack hands according to conventional blackjack rules; and resolving two wagers corresponding to the two blackjack hands.

2. The method of claim 1 wherein each of the two or more player wagers are of equal amounts.

3. The method of claim 1 further comprising the player forfeiting the bonus card and corresponding wager when the player opts to not utilize the third card with one of the two blackjack hands.

4. The method of claim 1 further comprising providing players an option to split, double down or surrender both blackjack hands.

5. The method of claim 1 facilitated by an electronic gaming machine.

6. A method of conducting a wagering game comprising:

accepting three individual wagers from each player;

dealing said players two face-up blackjack cards from one or more decks of standard playing cards wherein each of said two cards corresponds to one of the three wagers;

dealing each player a face-up bonus card corresponding to the third wager;

dealing a dealer one face-up card and one face-down card from the one or more decks of standard playing cards;

allowing said players to form two separate blackjack hands using the two face-up blackjack cards each in combination with the dealer's face-up card;

providing said players with option of utilizing the bonus card and corresponding wager in one of the two blackjack hands;

completing the two blackjack hands according to conventional blackjack rules; and resolving the two wagers corresponding to the two blackjack hands.

7. The method of claim 6 wherein each of the three player wagers are equal.

8. The method of claim 6 further comprising the player forfeiting the bonus card and corresponding wager when the player opts to not utilize the third card with one of the two blackjack hands.

9. The method of claim 6 further comprising providing players an option to split, double down or surrender both blackjack hands.

10. The method of claim 6 facilitated by an electronic gaming machine.

11. A method of conducting a wagering game comprising:

accepting two or more individual wagers from each player;

providing said players with three or more face-up cards from one or more decks of standard playing cards wherein each of said three or more cards corresponds to one of the two or more wagers;

providing a dealer with two cards, one card face-up, from the one or more decks of standard playing cards;

allowing said players to form two separate blackjack hands using two of the face-up player cards each in combination with the dealer's face-up card;

requiring said players to utilize the third player card and corresponding wager with one of the two blackjack hands;

completing the two blackjack hands according to conventional blackjack rules; and resolving two wagers corresponding to the two blackjack hands.

12. The method of claim 11 wherein each of the two or more player wagers are of equal amounts.

* * * * *